US008529386B2

(12) United States Patent
Nuernberg et al.

(10) Patent No.: US 8,529,386 B2
(45) Date of Patent: Sep. 10, 2013

(54) BALL

(75) Inventors: Hans-Peter Nuernberg, Gutenstetten (DE); Josh Robert Gordon, Herzogenaurach (DE); Timothy David Lucas, Herzogenaurach (DE); Harald Geyer, Lonnerstadt (DE); Janneke van Oorschot, Herzogenaurach (DE); Andy Harland, Leicestershire (DE)

(73) Assignee: adidas AG, Herzogenaurach (DE)

( * ) Notice: Subject to any disclaimer, the term of this patent is extended or adjusted under 35 U.S.C. 154(b) by 421 days.

(21) Appl. No.: 12/752,839

(22) Filed: Apr. 1, 2010

(65) Prior Publication Data

US 2010/0255940 A1 Oct. 7, 2010

(30) Foreign Application Priority Data

Apr. 3, 2009 (DE) ..... 10 2009 016 287

(51) Int. Cl.
*A63B 41/00* (2006.01)

(52) U.S. Cl.
USPC ..... 473/597; 473/604; 40/327

(58) Field of Classification Search
USPC ..... 473/596, 604, 605, 597, 603, 607; 40/327; D21/707, 713
See application file for complete search history.

(56) References Cited

U.S. PATENT DOCUMENTS

| | | | | | |
|---|---|---|---|---|---|
| 1,559,117 | A | * | 10/1925 | Maynard | 473/596 |
| 1,931,429 | A | * | 10/1933 | Buckner et al. | 473/596 |
| 2,149,465 | A | * | 3/1939 | Riddell | 473/604 |
| 2,280,314 | A | * | 4/1942 | Scudder | 156/213 |
| D198,924 | S | | 8/1964 | Satchell | |
| 4,000,894 | A | * | 1/1977 | Butzen | 473/596 |
| 4,318,544 | A | * | 3/1982 | Brine, Jr. | 473/596 |
| D268,853 | S | | 5/1983 | Brine, Jr. | |
| 4,570,931 | A | * | 2/1986 | Martin | 473/596 |
| 4,830,373 | A | | 5/1989 | Dehnert et al. | |
| 4,856,781 | A | | 8/1989 | Shishido et al. | |
| 5,165,685 | A | | 11/1992 | Hynes | |
| 5,470,060 | A | | 11/1995 | Spiegel | |
| D386,230 | S | | 11/1997 | Gray | |
| 5,709,623 | A | | 1/1998 | Schwaner | |
| 5,820,501 | A | * | 10/1998 | Soofi | 473/599 |
| 5,851,161 | A | | 12/1998 | Sassak | |
| D405,486 | S | | 2/1999 | Chan | |
| 5,888,157 | A | | 3/1999 | Guenther et al. | |

(Continued)

FOREIGN PATENT DOCUMENTS

| | | |
|---|---|---|
| BE | 1016122 A6 | 3/2006 |
| CN | 202136749 | 2/2012 |

(Continued)

OTHER PUBLICATIONS

European Search Report for European Application No. 10155323, European Patent Office, Munich, dated Jun. 18, 2010, 5 pages.

(Continued)

*Primary Examiner* — Steven Wong
(74) *Attorney, Agent, or Firm* — Sterne, Kessler, Goldstein & Fox P.L.L.C.

(57) ABSTRACT

The present invention relates to an inflatable ball, in particular a soccer ball, having an outer shell comprising a plurality of panels, wherein the panels are interconnected by seams and each panel comprises at least one pseudo-seam extending over at least a part of the outer surface of the panel.

26 Claims, 5 Drawing Sheets

(56) References Cited

U.S. PATENT DOCUMENTS

| | | | | |
|---|---|---|---|---|
| D408,876 | S * | 4/1999 | Feeney | D21/713 |
| 5,931,752 | A | 8/1999 | Guenther et al. | |
| D416,961 | S | 11/1999 | Sonntag et al. | |
| 5,984,812 | A | 11/1999 | Sassak | |
| D418,565 | S | 1/2000 | Burgess | |
| D439,294 | S | 3/2001 | Hall | |
| D440,614 | S | 4/2001 | Audero | |
| 6,302,815 | B1 | 10/2001 | Shishido et al. | |
| D452,721 | S | 1/2002 | Sonntag | |
| 6,422,961 | B1 | 7/2002 | Feeney | |
| D462,732 | S | 9/2002 | Morrison et al. | |
| 6,503,162 | B1 | 1/2003 | Shishido et al. | |
| 6,506,135 | B2 | 1/2003 | Ou | |
| D473,275 | S | 4/2003 | Gundra | |
| 6,612,948 | B1 | 9/2003 | Miller | |
| D483,424 | S | 12/2003 | Lowinger | |
| 6,685,585 | B2 | 2/2004 | Shishido et al. | |
| 6,752,732 | B2 | 6/2004 | Morrison et al. | |
| D510,113 | S | 9/2005 | Kelly | |
| D511,191 | S | 11/2005 | Fryer | |
| D511,551 | S | 11/2005 | Llewellyn | |
| 6,971,965 | B1 | 12/2005 | Shishido | |
| 6,988,969 | B2 | 1/2006 | Avis | |
| D516,647 | S | 3/2006 | Yang | |
| D520,086 | S | 5/2006 | Just et al. | |
| 7,066,853 | B2 * | 6/2006 | Chang | 473/605 |
| D527,432 | S | 8/2006 | Just et al. | |
| D529,107 | S | 9/2006 | Just et al. | |
| D533,239 | S * | 12/2006 | Yang | D21/713 |
| D544,053 | S | 6/2007 | Krysiak | |
| D544,931 | S * | 6/2007 | Laliberty et al. | D21/713 |
| D548,292 | S | 8/2007 | Smith | |
| D556,275 | S | 11/2007 | Crane et al. | |
| D558,285 | S | 12/2007 | Avis et al. | |
| D563,495 | S | 3/2008 | Torres | |
| D568,425 | S | 5/2008 | Oono | |
| 7,427,246 | B2 | 9/2008 | Taniguchi et al. | |
| 7,444,770 | B2 | 11/2008 | Wellington, Jr. | |
| D583,427 | S | 12/2008 | Saghir | |
| 7,462,119 | B2 | 12/2008 | Kelly | |
| D596,249 | S | 7/2009 | Katzke | |
| 7,585,236 | B2 * | 9/2009 | Krysiak | 473/604 |
| D603,916 | S | 11/2009 | Smith et al. | |
| D613,354 | S | 4/2010 | Van Oorschot | |
| D613,355 | S | 4/2010 | Van Oorschot | |
| D613,356 | S | 4/2010 | Van Oorschot | |
| D618,740 | S | 6/2010 | Van Oorschot | |
| D620,060 | S | 7/2010 | Gibson | |
| 7,749,116 | B2 | 7/2010 | Tang et al. | |
| D634,380 | S | 3/2011 | Walling, Jr. et al. | |
| 8,133,570 | B2 * | 3/2012 | Fujisawa et al. | 473/596 |
| 2004/0134136 | A1 | 7/2004 | Shearing | |
| 2004/0142780 | A1 | 7/2004 | Estefano | |
| 2005/0170920 | A1 | 8/2005 | Boyer et al. | |
| 2006/0105866 | A1 | 5/2006 | Ma | |
| 2006/0229150 | A1 * | 10/2006 | Ou | 473/604 |
| 2007/0037642 | A1 | 2/2007 | Chang | |
| 2007/0117662 | A1 | 5/2007 | Ma | |
| 2007/0225094 | A1 | 9/2007 | Nix | |
| 2008/0070727 | A1 * | 3/2008 | Avis et al. | 473/604 |
| 2008/0176685 | A1 | 7/2008 | Madore et al. | |
| 2008/0305900 | A1 | 12/2008 | Geisendorfer | |
| 2009/0011878 | A1 * | 1/2009 | Ou | 473/605 |
| 2009/0105019 | A1 | 4/2009 | Keppler et al. | |
| 2009/0209374 | A1 | 8/2009 | Ou | |
| 2009/0325740 | A1 * | 12/2009 | Krysiak | 473/596 |
| 2009/0325744 | A1 | 12/2009 | Raynak et al. | |
| 2010/0009790 | A1 | 1/2010 | Maziarz | |

FOREIGN PATENT DOCUMENTS

| | | | |
|---|---|---|---|
| DE | 3726830 | C1 | 12/1988 |
| DE | 20 2007 013 433 | U1 | 9/2008 |
| DE | 112008001626 | | 7/2010 |
| GB | 3021829 | | 8/2005 |
| JP | 35-12256 | | 6/1960 |
| JP | 55-91368 | | 7/1980 |
| JP | 58-152576 | | 9/1983 |
| JP | 59-125574 | | 7/1984 |
| JP | 59-125578 | | 7/1984 |
| JP | 59-232562 | | 12/1984 |
| JP | 60-018184 | | 1/1985 |
| JP | 60-024855 | | 2/1985 |
| JP | 60-199472 | | 10/1985 |
| JP | 60-199473 | | 10/1985 |
| JP | 60-199474 | | 10/1985 |
| JP | 1-212578 | | 8/1989 |
| JP | 1-265979 | | 10/1989 |
| JP | 7-080097 | | 3/1995 |
| JP | 8-155055 | | 6/1996 |
| JP | 8-196662 | | 8/1996 |
| JP | 9-019516 | | 1/1997 |
| JP | 11-089971 | | 4/1999 |
| JP | 11-155980 | | 6/1999 |
| JP | 2000-245875 | | 9/2000 |
| JP | 2001-170216 | | 6/2001 |
| JP | 2003-033448 | | 2/2003 |
| JP | 2008-080176 | | 4/2008 |
| JP | 2008-188038 | | 8/2008 |
| JP | 2010 35694 | | 2/2010 |
| TW | 462300 | | 11/2001 |
| WO | DM 057033 | | 9/2001 |
| WO | WO 2008/132793 | A1 | 11/2008 |
| WO | WO2008134029 | | 11/2008 |

OTHER PUBLICATIONS

English-language Abstract of BE 1016122 (A6), Published on Mar. 7, 2006.

Saturnian Fun Gripper 36" Oversized Soccer Ball [online]. Retrieved from the Internet: http://www.cdntoyassn.com/details.cfm?id=619, [retrieved on Jan. 12, 2007].

Puma V1.06 FIFA A Soccer Ball, [online]. Retrieved from the Internet: http://www.newhorizonssoccer.com/prod.itml/icOid/1976, [retrieved on Jan. 12, 2007].

CSI "Tiger" Practice Rubber Soccer Ball, [online]. Retrieved from the Internet: http://ecx.images-amazon.com/images/I/516z5uccDL._SS500_.jpg, [retrieved on Jan. 12, 2007].

Office Action dated Jun. 8, 2009 from U.S. Appl. No. 29/335,431, van Oorschot, Ball, filed Apr. 15, 2009.

Office Action dated Jun. 8, 2009 from U.S. Appl. No. 29/335,432, van Oorschot, Ball, filed Apr. 15, 2009.

Office Action dated Jun. 8, 2009 from U.S. Appl. No. 29/335,433, van Oorschot, Ball, filed Apr. 15, 2009.

Villa Giocattoli 1995 product catalog, p. 45: ball (item art. 550) shown on the lower portion of page.

Ball shown on webpage: http://www.discountattic.com/36605-WorldSoccerBall.jpg, display date Jun. 30, 2009.

Office Action date Mar. 12, 2009 from U.S. Appl. No. 29/327,904, van Oorschot, Ball, filed Nov. 14, 2008.

* cited by examiner

BALL

BACKGROUND OF THE INVENTION

1. Field of the Invention

The present invention relates to an inflatable ball, in particular a soccer ball, having a shell comprising a plurality of panels.

2. Background Art

Soccer balls, as well as other inflatable balls, are typically produced as follows. In a first step an inner bladder, which can be made from latex, is reinforced with a carcass, or by a nylon thread wound around the bladder. An outer shell is then arranged on the carcass or on the nylon winding.

For simple balls the shell can be integrally formed of plastic material, or two preformed half shells of the ball shell are connected to each other, for example by gluing or sealing, as it is disclosed in FIG. 5 of the U.S. Pub. No. 2009/0011878. The present invention is related to higher quality balls. The shell of high quality balls is composed of a multitude of prefabricated panels. To clearly distinguish these two fundamentally different constructions of a ball shell (i.e., a shell formed from two half shells and a shell formed from a multitude of prefabricated panels), in the following the term panel is taken to mean a separately prefabricated portion which forms less than a half of the ball shell.

The panels must be suitably attached relative to each other, for example by sewing the edges of the panels together or also by gluing the panels to the surface of the carcass. A direct gluing or (laser) welding of the edges of the panels to each other is also conceivable. For the sake of simplicity, the region in which two adjacent panels contact each ether, is simply called a "seam" in the following description, regardless of whether the panels are actually sewn to each other in a standard manner or whether they are fixed relative to each other in any other way in order to provide the outer shell of the ball.

In the past, the shell of soccer balls typically consisted of 32 pentagonal and/or hexagonal panels. However, more recent ball designs have a lower number of larger-sized panels. The new designs improve the ball control by the player, since each seam creates an inhomogenity, typically a localized stiffness, in the outer shell so that the ball reacts differently when kicked with a shoe in the centre of a panel than when being kicked in the seam area. Unavoidable production tolerances during the manufacture of the seam result in an oven greater inhomogeneity and are another reason why the player cannot perfectly control the ball and that a shot ball does not follow a precise flight path. Furthermore, the arrangement of many seams leads to deviations from perfect sphericity.

Using larger panels reduces these problems, since less seams are needed for the manufacture of the overall shell of a ball having the same size. In addition, the manufacturing costs are reduced for larger panels, since less effort is needed to interconnect the panels and/or to arrange them on the carcass. Also the production tolerances are lower since there are less possibilities to create faulty seams during production. This applies for the frequency of occurrence as well as for the extent of such production tolerances.

However, balls having large panels can have negative flight properties and can, for example, tend to have instability. As a result of aerodynamic effects, there can be unintended and unpredictable flutter movements of the ball. It is immediately apparent that these aerodynamic effects substantially impair a controlled play and precise shots. Similar problems also occur for inflatable balls for others sports, such as handball and volleyball.

For improving the aerodynamic properties, it is known from the U.S. Pat. No. 4,318,544 to provide a soccer ball with seven parallel grooves extending in a uniform pentagonal arrangement over the complete shell of the ball. The arrangement is such that there are no grooves on certain panels of the shell of the ball, whereas up to three groups of seven parallel grooves contact each other on other panels.

While this arrangement may improve the flight properties of the ball, it does not improve precision during play. The extremely different surface design of the panels leads to a very different behavior of the ball when contacting a shoe of a player. Both, during dribbling, but also for an aimed shot, the ball will behave differently depending on whether the shoe of the player hits a panel provided with the seven parallel grooves or a standard panel without any ridges.

Embodiments of the present invention are, therefore, based on the problem to provide a ball, in particular a soccer ball, having good properties both, when contacting the shoe of the player but also in the air, and therefore allows more precise play.

BRIEF SUMMARY OF THE INVENTION

In one embodiment, the ball may comprise an outer shell having a plurality of panels, wherein the panels are interconnected by seams. Each panel may comprise at least one pseudo-seam, which extends at least over a part of an outer surface of the panel.

As a result of the pseudo-seams of the invention and their distribution on each panel, the panels of the ball of the invention can be made larger so that the number and the lengths of the seams of the outer shell are reduced. In contrast to real seams, the pseudo-seams have no practical influence on the deformation properties and the contact properties of the panels. However, they have approximately the same aerodynamic effect as real seams and thereby avoid the unintended flutter movements in the flight path. This applies in particular, if the pseudo-seams have a cross section corresponding essentially to the cross section of a seam between two panels, for example an essentially V- or U-shaped cross section having a width in a range from about 1 mm to about 3 mm, for example about 2 mm, and a depth in a range from about 0.5 mm to about 2 mm, for example about 1 mm.

The term "substantially" means in this context, as well as generally within the present description, an accuracy within the limits of production tolerances.

In contrast to the prior art according to the above explained U.S. Pat. No. 4,318,544, each panel may comprise at least one pseudo-seam so that the effect on the aerodynamic properties is evenly distributed over all panels and thereby the complete outer shell. This may lead to improved flight properties. Also the local modification of the deformation properties and the contact properties by the pseudo-seam, which are only minor, is evenly distributed on each panel. As a result, a ball is provided which can be perfectly controlled on the shoe and in the air and allows very precise play.

Apart from the more homogeneous deformation and contact properties and the better flight properties, the ball of the invention can also be more cost-efficiently produced since the outer shell is assembled from a lower number of larger panels. Gluing, sewing or any other method to interconnect the panels therefore requires less process steps and working time and can be performed with lower production tolerances.

In some embodiments, the pseudo-seams may extend over the outer surface such that each panel is divided into at least two sub-panels. From an aerodynamic point of view, the ball therefore appears as if it was made of a plurality of small panels and enables precise flight paths without any flutter movements.

In some embodiments, in order to achieve an even distribution over the outer surface, the pseudo-seams may be arranged so that they are not parallel on the outer surface of a panel. On the contrary, in some embodiments, each pseudo-seam may either substantially interconnect two seams, or may form a closed curve on the outer surface of the panel. Other embodiments, are however, also conceivable in which each panel may be divided into four sub-panels by three arcuated pseudo-seams and/or modifications in which one or several additional pseudo-seams are foreseen which may extend parallel to an edge of a sub-panel over at least a part of its surface.

As already mentioned, the outer shell of the ball of the invention can be manufactured from a lower number of panels. In some embodiments, the outer shell may comprise twelve or less panels. In other embodiments, the outer shell may comprise eight panels or less. As a result, a ball may be provided having substantially more homogeneous deformation and contact properties so that it can be precisely controlled by the shoe of the player.

In some embodiments, the outer shell may comprise a first and a second group of panels, each panel of the first group having the shape of a rounded triangle with convex edges and each panel of the second group having six corners with alternating concave and essentially straight edges. The convex edge of a panel of the first group can form a seam with the concave edge of a panel of the second group. Comprehensive tests have revealed that this panel form and the seam distribution resulting out of it are especially beneficial for the play properties of the ball.

In order to avoid excessive tensions in the shell, in some embodiments, the panels may comprise a three-dimensionally domed shape prior to interconnecting them to form the outer shell. This can be achieved by suitable manufacturing methods of the materials used for the panels, such as deep-drawing using a domed mold. Injection molding of the panels is however also conceivable to manufacture complex designs with little effort.

In addition to the pseudo-seams, which serve for improving the aerodynamic properties, in some embodiments, each panel may further comprise a surface texture having a height of ≦ about 0.5 mm, for example ≦ about 0.05 mm. These surface textures or corrugations may be substantially smaller than the pseudo-seams and are therefore of less relevance for the aerodynamic properties of the ball. However, they improve the grip of the ball, in particular when wet, and therefore, facilitate ball control and catching or halting of the ball by the goal keeper.

In some embodiments, each panel may comprise at least one backing material and at least one surface material, wherein the pseudo-seam may be provided in both the backing material and the surface material.

In some embodiments, the backing material may comprise a foamed material and the surface material may comprise at least one thermoplastic polyurethane (TPU) film. Other materials can also be used for the plastic films, as for example polyurethane (PU), polyamide (PA), or polyvinyl chloride (PVC). The pseudo-seams and/or the surface texture can be created in many different ways, such as master forming of the surface material and/or the backing material, for example by (multi-component) injection molding, vacuum-forming, deep-drawing and/or laser etching of the TPU film and/or the backing material.

BRIEF DESCRIPTION OF THE DRAWINGS/FIGURES

In the following, aspects of the present invention are described in more detail with reference to the accompanying figures. These figures show:

FIG. 1 is a schematic presentation of the flutter movement of a ball due to aerodynamic effects in top view;

FIGS. 2*a, b* are presentations of a presently preferred embodiment of a ball according to the present invention;

DETAILED DESCRIPTION OF THE INVENTION

In the following, preferred embodiments and modifications of the present invention are described with reference to a soccer ball. However, it is to be understood that the present invention is not limited to soccer balls. On the contrary, also other inflatable balls, such as handballs, basketballs, volleyballs, balls for American Football etc. may comprise the features of the present invention.

Figure 1:
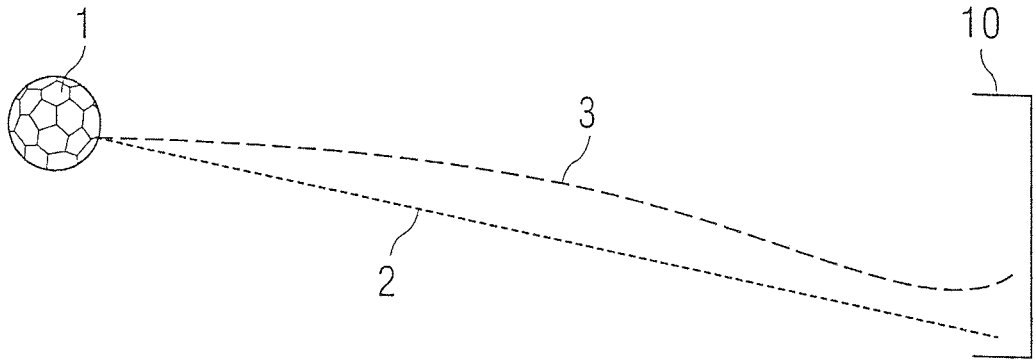

FIG. 1 illustrates the basic problem of a flutter movement of a ball. Without aerodynamic effects, the flight path of the ball 1 would follow a straight trajectory 2 into the right corner of the goal 10. However, due to aerodynamic effects, it may under certain conditions occur that lateral forces are exerted on the ball. The direction of these lateral forces can change over the flight path so that the ball 1 moves along the curved trajectory 3. It is apparent that such a flight behavior impairs precise play.

Extensive experimental tests in a wind tunnel have shown that the probability of flutter movements occurring depends on a number of parameters. An important parameter is, how "smooth" the surface of the ball is. Balls having an outer shell made from a plurality of small panels, such as the ball shown in FIG. 1, which consists of 32 pentagons and/or hexagons, have generally a lower tendency to flutter movements than balls having an outer shell consisting of a lower number of larger panels. The high number of seams on the surface of a known ball avoids the asymmetric separation of turbulences and thereby the flutter movement of the ball. Apparently, it is decisive how many seams are met by the air flow around the ball.

However, it was already mentioned in the introductory part that the arrangement of the plurality of seams causes other difficulties, such as inhomogeneous deformation properties and contact properties of the ball over its outer shell, high manufacturing costs and large production tolerances. The latter can also negatively affect the good flight properties of such a ball. If not all of the seams are perfect, this may cause substantial deviations from a straight flight path.

Figure 2A:
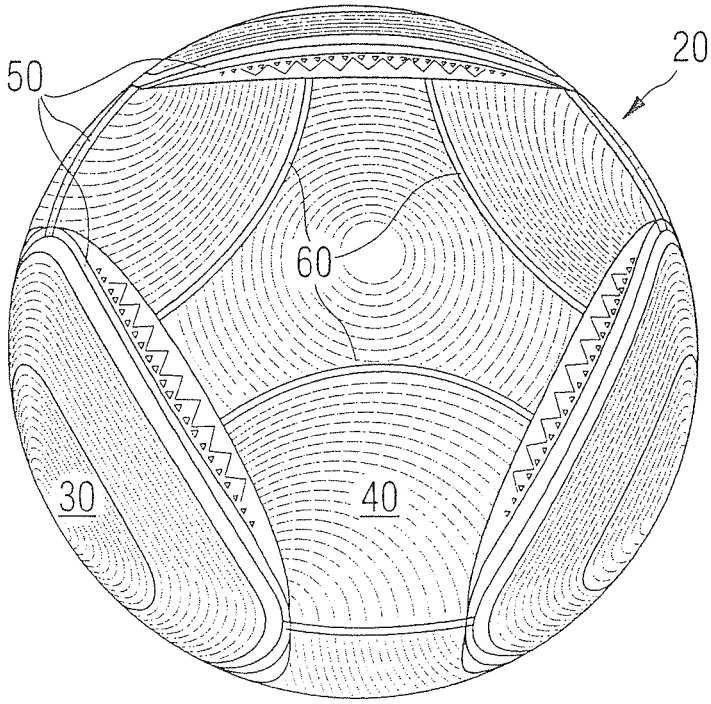
Figure 2B:
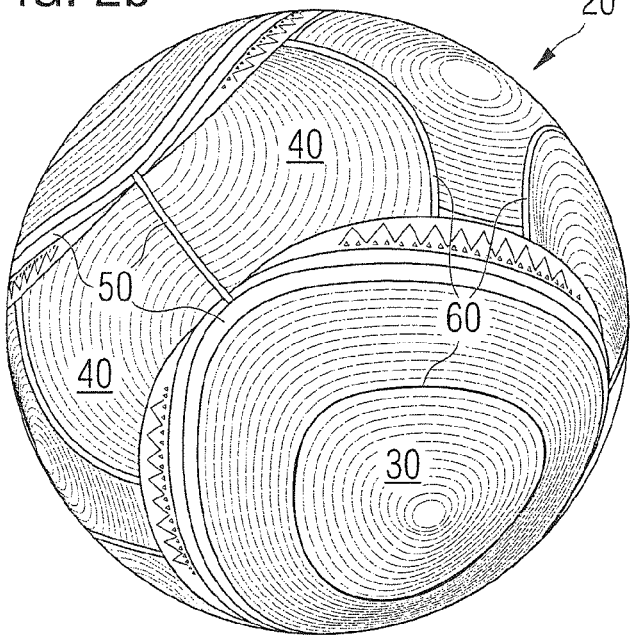

FIGS. 2*a* and 2*b* present an embodiment of a ball 20 according to the present invention, which overcomes these difficulties but also allows a flight path without a noticeable flutter movement. The presented ball 20 comprises two groups of panels, a first group of panels 30 and a second group of panels 40, which are individually shown in FIGS. 3 and 4. Panels 30 of the first group have a substantially rounded triangular shape, wherein not only the corners of the triangle are rounded but wherein also the three side edges are provided with a convex curvature. Panels 40 of the second group have six corners, which are connected via alternating concave and substantially straight edges.

Where the edges of the panels 30, 40 contact each other, the ball 20 comprises seams 50. These seams 50 can be provided in many different ways. In the presented embodiment, the panels 30, 40 are glued to a carcass (not shown). At the same time, also the lateral edges of the panels 30, 40 are glued to each other so that the seams 50 are provided as bond seams. However, it is also conceivable to interconnect the panels 30, 40 in other ways along the seams 50, such as by sewing, by welding of a suitable plastic material, or the like. Another option is to glue the panels 30, 40 only to the carcass without any bond or other direct interconnection between contacting panels 30, 40. In this case, the seams 50 are exclusively defined by the contact area or the transition region between two adjacent panels 30, 40.

Figure 6:
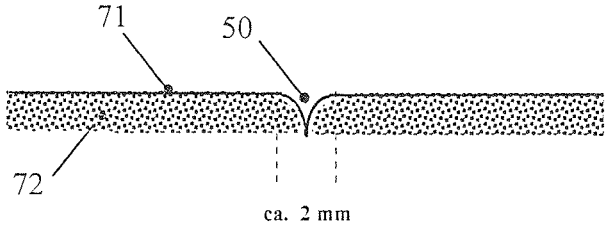
FIG. 6 is a schematic presentation of a seam between two panels.
Figure 7:
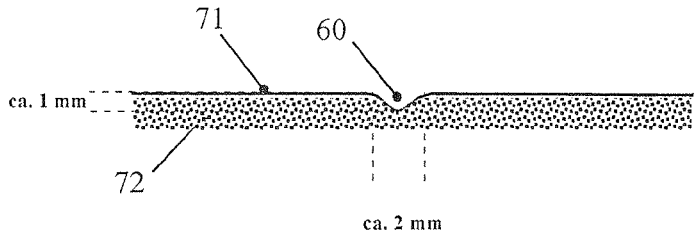
FIG. 7 is a schematic presentation of a pseudo-seam.

The deterioration of the flight properties as a result of the use of a lower number of larger panels can be avoided if pseudo-seams 60 are arranged on the surface of the panels 30, 40. As shown in FIGS. 6 and 7 and described in more detail below, the pseudo-seams 60 on the surface of the panels 30, 40 have essentially the same cross section as the above described seams 50. As a result, the ball 20 obtains aerodynamic properties corresponding to a ball having a substantially higher number of panels. In particular, the above described flutter movement of the ball is to a large extent avoided.

As can be seen in FIGS. 2*a* and 2*b*, in some embodiments, three pseudo-seams 60 may extend in an arcuate manner over the surface of the panel 40. The panel 40 is thus divided into four sub-panels having essentially the same size. The pseudo-seams 60 extend separately from each other and are not parallel on at least a part of the surface of the panel 40. Further, they meet the seams 50 in an essentially orthogonal arrangement, however, without intersecting the seams 50. In another embodiment, it is however also possible that the pseudo-seams 60 actually intersect the seams.

In some embodiments, the surface of the panels 30 of the other group may also have a pseudo-seam 60. This pseudo-seam 60 forms a closed curve and may extend essentially parallel to the seam 50, which limits the panel 30. Also the panel 30 may be divided by the arrangement of the pseudo-seam 60 into two sub-panels. In some embodiments, these sub-panels have approximately the same size.

Figure 3:
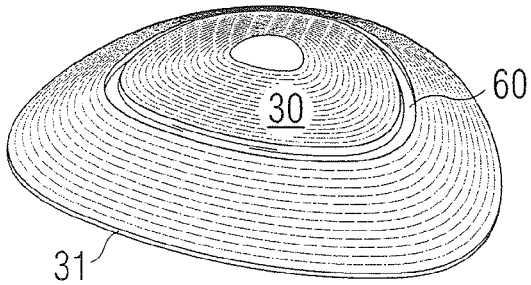
FIG. 3 is a detailed presentation of a panel of a first group of panels in the embodiment of FIGS. 2*a, b;*
Figure 4:
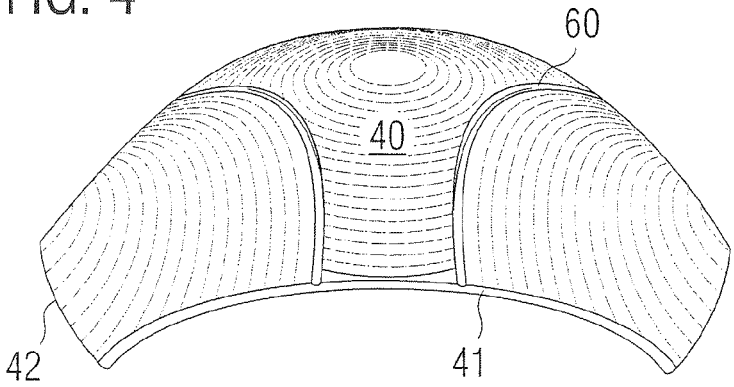
FIG. 4 is a detailed presentation of a panel of the second group of panels in the embodiment of FIGS. 2*a, b;*

FIGS. 3 and 4 show detailed presentations of the panels 30 (FIG. 3) and 40 (FIG. 4), respectively. Apart from the already explained pseudo-seams 60, the Figures show that the individual panels 30, 40 of the ball 20 have preferably a domed, three-dimensional shape after their manufacture, but before being glued or otherwise joined together. In contrast to the panels of a standard soccer ball made from 32 pentagons and/or hexagons, which are typically punched out of a flat shell material, such as (artificial) leather, and which are brought into a three-dimensional shape only on the carcass/bladder of the ball, the panels 30, 40 are provided with the shape shown in FIGS. 3 and 4 already prior to being attached to the ball 20. As a result, excessive tensions in the panels 30, 40 after assembly to the outer shell may be avoided, which could negatively affect the deformation properties of the ball 20. This is particularly important for a ball 20 having very large panels. However, the described domed shape is also preferable for smaller panels. An exemplary manufacturing method for domed, three-dimensional panels is disclosed in EP 1 424 105 A1, which has been submitted by applicant together with the company Molten Corporation, which is hereby incorporated in its entirety.

FIGS. 3 and 4 show in addition the preferred shape of the edges of the two panels 30, 40. The panel 30 may have convex edges 31, which form after attachment to the carcass of a ball 20 (not shown) a seam 50 together with corresponding concave edges 41 of the panels 40. The long, slightly curved seam 50 fits particularly well to the spherical shape of the final ball 20 (cf. FIGS. 2*a*, and *b*) and thus may avoid tensions and the creation of stiff areas along the seam 50. FIG. 4 also shows the essentially straight edges 42, which alternate with the concave edges 41.

Figure 5:
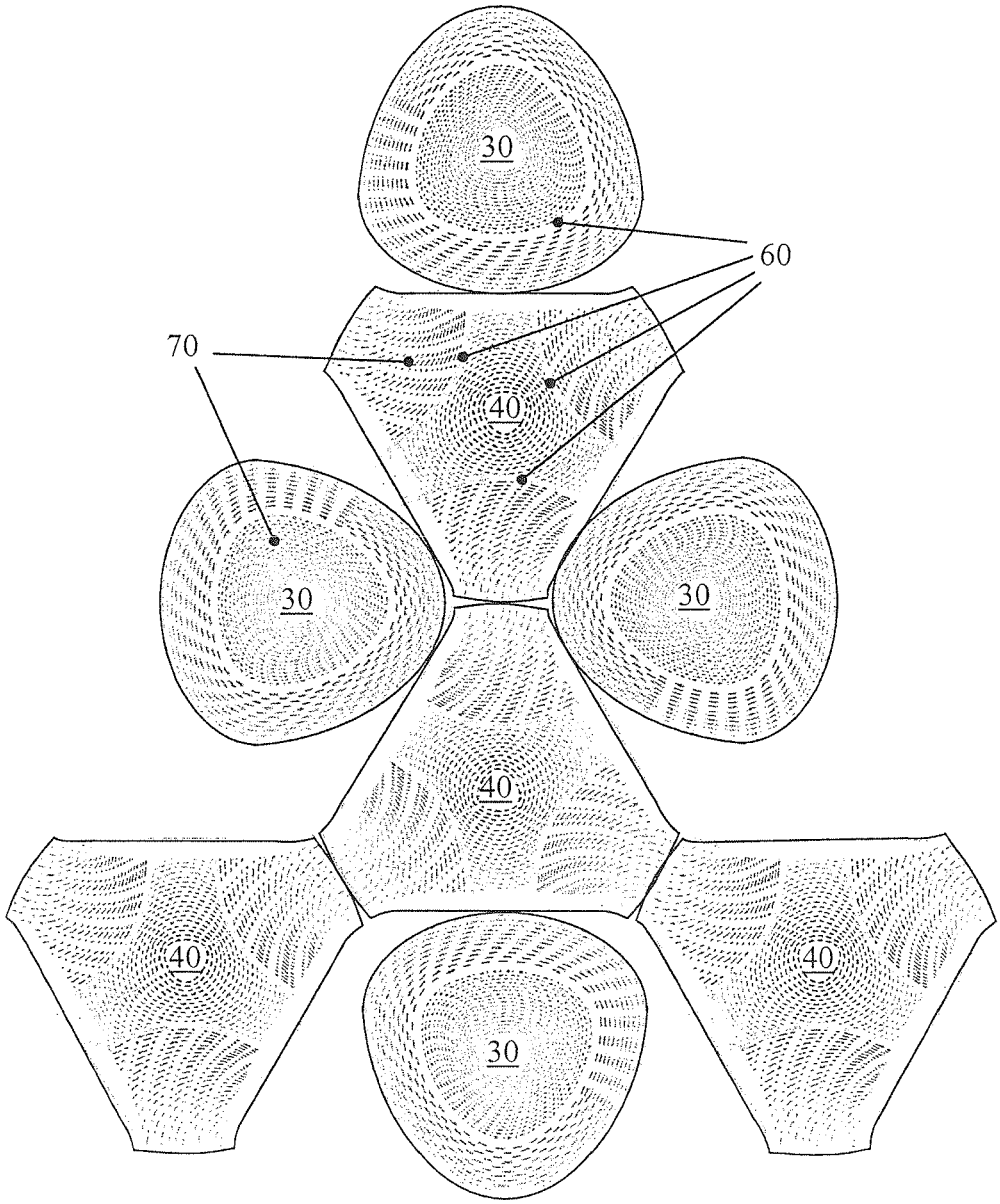
FIG. 5 is a two-dimensional presentation of all of the panels of the embodiments of FIGS. 2*a, b;*

FIG. 5 shows a schematic presentation of some embodiments of panel shapes 30, 40 and their relative arrangement after "unfolding" of the outer shell of the ball 20. It can be seen, that in this embodiment, the overall outer shell may be made from only eight panels 30, 40, four of which have the shape of the above explained panels 30 and four of which have the shape of the above explained panels 40. It is apparent that the effort, but also the manufacturing tolerances of the seams, may be substantially lower for such a small number of panels than in the case of the standard 32 pentagons and/or hexagons. However, neither the above described panel shapes, nor the use of exactly eight panels is essential for the present invention. Other panel shapes and numbers, for example twelve panels, can also lead to advantageous ball properties. In other embodiments, six uniform panels may be used.

FIG. 5 shows in addition once more the pseudo-seams 60 extending on the panels 30 and 40. In particular, the closed curve of the pseudo-seam 60 on the panels 30 can be seen, which may extend essentially parallel to the edge of the panel 30. Also, the three individual pseudo-seams 60 on the panels 40 can be seen extending substantially orthogonal starting from the edge of a panel 40 in an arcuate manner over its surface and thereby dividing the panel 40 into four sub-panels. Tests in a wind tunnel have shown that the panel shapes 30, 40 and the distribution of the pseudo-seams of FIG. 5 lead to particular advantageous flight properties of the ball, showing the lowest amount of flutter movements.

Figure 9:
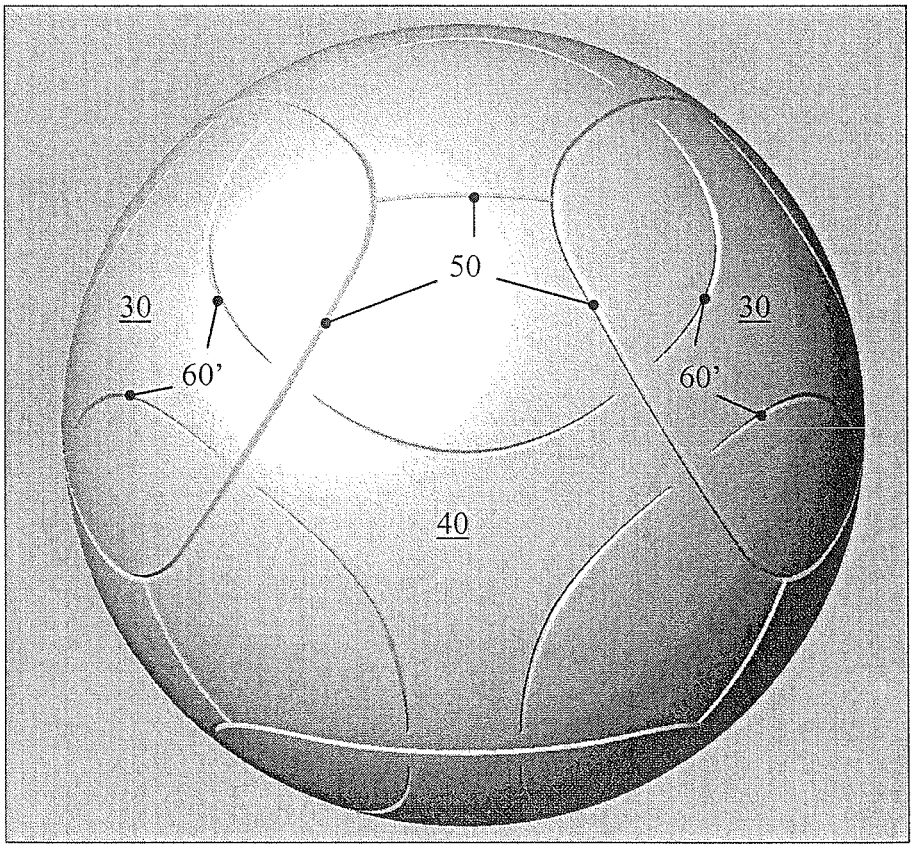
FIG. 9 is a schematic representation of an embodiment of a ball with pseudo-seams.

FIG. 9 represents a further embodiment. Instead of pseudo-seams in form of a closed curve, pseudo-seams 60' are here also arranged on the panels 30 which substantially extend from a seam 50 to another seam 50 so that each panel 30 is divided in four sub-panels similar to each panel 40. In a modification of this embodiment (not shown) further pseudo-seams extend parallel to the curved pseudo-seams on the panels 30, 40, which in some embodiments, may have a slightly smaller length and a slightly lower depth as the other pseudo-seams of the panels 30, 40.

Apart from the described pseudo-seams 60, 60', the hatch in FIG. 5 further indicates a surface texture 70 on the panels 30, 40. Apart from the edge regions of the panels 30, 40 and the regions of the pseudo-seams 60, the surface texture 70 may cover in some embodiments, the complete area of each panel 30, 40. As a result, the grip of the ball 20 is improved, which facilitates the ball control at the foot, but also catching the ball by the goal keeper. The surface texture 70 may be provided by a number of individual projections or recesses on the panels 30, 40. In some embodiments the individual projections or recesses may have a length in a range from about 1 mm to about 10 mm and a width in a range from about 0.5 mm to about 2 mm. They may be arranged in concentric circles on the outer circles of the panels 30, 40. Alternatively, the individual projections can also be formed as conical, dome-shaped, pyramidal, etc.

An important aspect is that the projections do not excessively extend above the surface of the panel, which would lead to a substantial influence on the aerodynamic properties of the ball. In some embodiments, the height of the projections of the surface texture 70 may be ≦ about 0.5 mm. For example, in some embodiments, the height may be ≦ about 0.05 mm.

The pseudo-seams 60, as well as the surface textures 70, of the panels 30, 40 can be created with different manufacturing methods. In the method disclosed in the above mentioned EP 1 424 105 A1, each panel 30, 40 comprises a surface material, made for example from thermoplastic polyurethane (TPU), as well as a backing material, which may for example be a PU foam. Other exemplary backing materials are disclosed in the EP 0 894 514 A2 of applicant, which is hereby incorporated in its entirety. According to the method disclosed in EP 1 424 105 A1, for the manufacturing of a ball 20, the surface material may be molded by deep-drawing in a mold to provide the above described three-dimensional dome shape and the pseudo-seams 60 and, if desired, the surface texture 70.

In a similar manner, the backing material may be foamed, which may at the same time be interconnected to the surface material. The produced panels 30, 40 may have a thickness in a range from about 2 mm to about 10 mm, and in some embodiments may have a thickness in the range from about 3 mm to about 6 mm. In some embodiments, the surface material of the finished panel may extend at the edges around the backing material and can therefore be used for providing the seams 50 by gluing, welding, sewing or the like (cf. also FIG. 6).

Apart from the described deep-drawing, other forming methods for plastic materials known to the person skilled in the art can be used for producing the panels 30, 40, such as vacuum-forming. In this case, a TPU film or a film made from another suitable plastic material is heated and brought into the desired shape by means of a mold and a vacuum. Also in this method, the surface can be provided with the pseudo-seams 60 and, if desired, with the described surface texture 70 during molding.

Injection molding may also be used for master forming of the panels. In doing so, the surface material and the backing material for a panel can either be successively master formed and glued or can concurrently be injection molded as a two component injection molding or can be injection molded successively with the aid of an insert between layers in a mold. Materials may comprise two component foams of materials with different densities or with different colors. Foams of different colors which are arranged in a panel side by side with a transparent TPU film as surface material opens new design possibilities. A hybrid type of master forming and shaping is also conceivable, for example if the injection molded part which is not completely hardened, is additionally deformed by embossing or by other methods.

Moreover, it is also possible to process the surface after forming/molding, for example by etching with a laser or embossing with a suitable mechanical device. Etching with a laser is particularly advantageous, if the precision of the created structure is important as in the case of the pseudo-seams 60 (see below). A combination of the above methods may also be used, wherein some of the elements of the surface of the panels 30, 40 are created during molding and wherein other elements are created later by processing the surface material and/or the backing material.

Independent of the manufacturing methods used, the panels 30, 40 may comprise several layers made from different backing materials as well as several layers of surface material. Complexes of several layers of a backing material are exemplary explained in the above mentioned EP 0 894 514 A2. Using several TPU layers with different colors for the surface material enables the creation of a particular optical design. For example, a laser may subsequently selectively etch away parts of an upper TPU layer to expose a lower TPU layer of different color. This enables, for example, a simple personalization of a ball, if a long time after its fabrication individual information or graphic arts are generated with a laser for example after an important game.

FIGS. 6 and 7 illustrate the similarity of the shape of the seams 50 and the pseudo-seams 60. These Figures are schematic drawings which are not true to scale. As can be seen, the seams 50 as well as the pseudo-seam 60 may have a cross section with a width of approximately 2 mm. In order to be as similar as possible to the shape of the seam 50 and to create similar aerodynamic effects, the pseudo-seam 60 may have an essentially V- or U-shaped cross section with a depth of approximately 1 mm (see FIG. 7). For the long-term stability of the panel 30, 40, it is advantageous if, as shown in FIG. 7, the pseudo-seam 60 is not only provided in the surface material 71 but also in the backing material 72.

The values of a width of approximately 2 mm and a depth of approximately 1 mm, discussed above, are exemplary; however, they contribute to an optimization of the flight properties of the ball 20.

Figure 8:
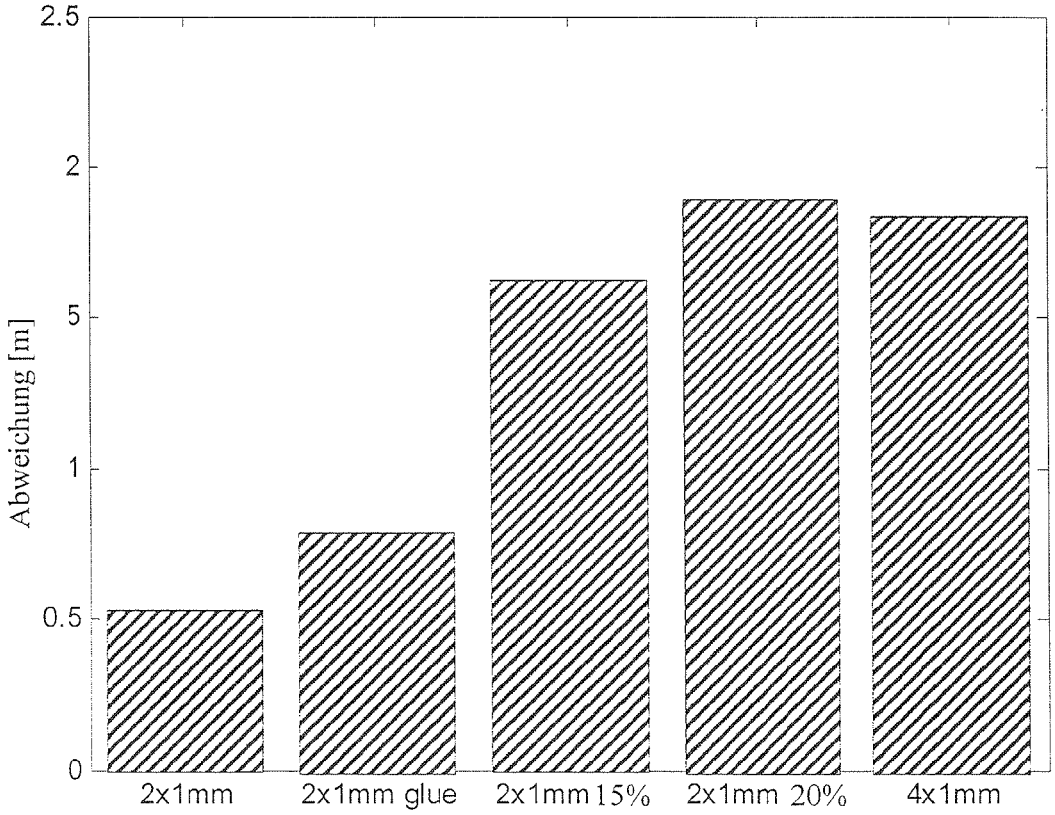
FIG. 8 is a diagram for comparing flutter movements of balls with different geometries and qualities of the seams.

FIG. 8 shows a comparison of deviations from a perfect flight path due to flutter movements for balls having the same seam and pseudo-seam distribution, but different seam cross sections and poorly processed seams, respectively.

FIG. 8 shows that a ball having perfect (pseudo-) seams with a width of 2 mm and a depth of 1 mm causes the lowest amount of flutter deviations. The average deviation increases for a ball having glue residues in the seams to a ball having 15% and 20% "faulty" (pseudo-) seams, respectively, up to a ball wherein all (pseudo-) seams have a width of 4 mm and a depth of 1 mm. This comparison shows that the values indicated in the claims of a width in a range from about 1 mm to about 3 mm, preferably about 2 mm and a depth in a range from about 0.5 mm to about 2 mm, preferably about 1 mm, indeed contribute to substantial improvements in the precision of flight path.

What is claimed is:

1. An inflatable ball comprising:

an outer shell having a plurality of panels having at least one backing material and at least one surface material, wherein:

the plurality of panels are interconnected by seams;

each of the plurality of panels comprises at least one pseudo-seam provided in both the backing material and the surface material extending at least over an outer surface of the panel; and at least one pseudo-seam forms a closed curve and does not cross a seam.

2. The inflatable ball according to claim 1, wherein the pseudo-seams have a cross sectional shape corresponding essentially to a cross sectional shape of the seams.

3. The inflatable ball according to claim 2, wherein the pseudo-seams have an essentially V- or U-shaped cross section with a width in a range from about 1 mm to about 3 mm, and a depth in a range from about 0.5 mm to about 2 MM.

4. The inflatable ball according to claim 1, wherein the pseudo-seams extend over the outer surface of each of the plurality of panels such that each of the plurality of panels is divided into at least two sub-panels.

5. The inflatable ball according to claim 1, wherein the pseudo-seams are not parallel on the outer surface of a panel.

6. The inflatable ball according to claim 1, wherein each pseudo-seam either essentially interconnects two seams or forms a closed curve on the outer surface of the panel.

7. The inflatable ball according to claim 6, wherein each pseudo-seam, which forms a closed curve, extends essentially parallel to the seam surrounding the respective panel.

8. The inflatable ball according to claim 1, wherein the outer shell comprises twelve or fewer panels.

9. The inflatable ball according to claim 1, wherein the plurality of panels comprises a first group of panels and a second groups of panels, wherein each panel of the first group has the shape of a rounded triangle with convex edges and wherein each panel of the second group comprises six corners connected by alternating concave edges and essentially straight edges.

10. The inflatable ball according to the claim 9, wherein the convex edge of a panel of the first group forms a seam together with the concave edge of a panel of the second group.

11. The inflatable ball according to claim 1, wherein each of the plurality of panels has a three-dimensionally domed shape in an un-stressed state.

12. The inflatable ball according to claim 1, wherein each of the plurality of panels further comprises a surface texture.

13. The inflatable ball according to claim 12, wherein the surface texture comprises a height of <about 0.5 mm.

14. The inflatable ball according to claim 1, wherein the pseudo-seams are created by vacuum molding or deep-drawing of the surface material.

15. The inflatable ball according to claim 1, wherein the pseudo-seams are created by laser etching, embossing, or master forming of the surface material and the backing material.

16. The inflatable ball according to claim 1, wherein the pseudo-seams are created by master forming of the surface material, and wherein the master forming comprises injection molding of the surface material and the backing material.

17. The inflatable ball according to claim 1, wherein the backing material comprises a foamed material.

18. The inflatable ball according to claim 1, wherein the surface material comprises at least a plastic film.

19. An inflatable ball comprising:

an outer shell having a plurality of panels having at least one backing material and at least one surface material, wherein:

the plurality of panels are interconnected by seams;

each of the plurality of panels comprises at least one pseudo-seam provided in both the backing, material and the surface material extending at least over an outer surface of the panel;

at least one pseudo-seam forms a closed curve and does not cross a seam;

the pseudo-seams have a cross-sectional shape corresponding to a cross-sectional shape of the seams and a depth of the pseudo-seams is less than a depth of the seams; and each of the plurality of panels has a three-dimensionally domed shape in an un-stressed state.

20. The inflatable ball according to claim 19, wherein the pseudo-seams have an essentially V- or U-shaped cross section with a width in a range from about 1 mm to about 3 mm and a depth in a range from about 0.5 mm to about 2 mm.

21. The inflatable ball according to claim 20, wherein the width of the cross section of the pseudo-seams is about 2 mm and the depth of the cross section of the pseudo-seams is about 1 mm.

22. The inflatable ball according to claim 21, wherein each of the plurality of panels further comprises a surface texture.

23. The inflatable ball according to claim 22, wherein the surface textures comprise a height of <about 0.5 mm.

24. The inflatable ball according to claim 23, wherein the height of the surface textures is <about 0.05 mm.

25. An inflatable ball comprising:

an outer shell comprising twelve or fewer panels having at least one backing material and at least one surface material, wherein:

the panels are interconnected by seams;

each of the twelve or fewer panels comprises at least one pseudo-seam provided in both the backing material and the surface material extending at least over an outer surface of the panel;

at least one pseudo-seam forms a closed curve and does not cross a seam; and at least one pseudo-seam of a panel is not parallel to another pseudo-seam of the same panel.

26. The inflatable ball according to claim 1, wherein each of the plurality of panels has a three-dimensionally domed shape prior to being interconnected to form the outer shell.

* * * * *

UNITED STATES PATENT AND TRADEMARK OFFICE

CERTIFICATE OF CORRECTION

PATENT NO. : 8,529,386 B2
APPLICATION NO. : 12/752839
DATED : September 10, 2013
INVENTOR(S) : Hans-Peter Nuernberg et al.

It is certified that error appears in the above-identified patent and that said Letters Patent is hereby corrected as shown below:

In the Claims

Column 8, line 65 (claim 3): "about 2 MM." should be --about 2 mm.--

Column 9, line 30 (claim 13): "height of <about 0.5 mm." should be --height of ≤ about 0.5 mm.--

Column 10, line 7 (claim 19): "the backing, material" should be --the backing material--

Column 10, line 28 (claim 23): "height of <about 0.5 mm." should be --height of ≤ about 0.5 mm.--

Column 10, line 30 (claim 24): "textures is <about 0.05 mm." should be --textures is ≤ about 0.05 mm.--

Signed and Sealed this
Eleventh Day of February, 2014

Michelle K. Lee

Michelle K. Lee
*Deputy Director of the United States Patent and Trademark Office*